United States Patent [19]

Fukasawa et al.

[11] Patent Number: 4,659,511

[45] Date of Patent: Apr. 21, 1987

[54] METHOD FOR SOLIDIFYING RADIOACTIVE WASTE

[75] Inventors: Tetsuo Fukasawa, Hitachi; Masaharu Ohtsuka, Sapporo; Naohito Uetake, Hitachi; Yoshihiro Ozawa, Mito, all of Japan

[73] Assignee: Hitachi, Ltd., Tokyo, Japan

[21] Appl. No.: 697,581

[22] PCT Filed: May 18, 1984

[86] PCT No.: PCT/JP84/00250

§ 371 Date: Jan. 16, 1985

§ 102(e) Date: Jan. 16, 1985

[87] PCT Pub. No.: WO84/04624

PCT Pub. Date: Nov. 22, 1984

[30] Foreign Application Priority Data

May 18, 1983 [JP] Japan ..... 59-85828
May 30, 1983 [JP] Japan ..... 59-95376

[51] Int. Cl.[4] ..... G21F 9/16

[52] U.S. Cl. ..... 252/628; 106/76; 106/84; 106/97; 106/98; 210/751; 252/631

[58] Field of Search ..... 252/628, 631; 106/74, 106/76, 84, 97, 85, 89, 98; 405/128, 129; 210/751

[56] References Cited

U.S. PATENT DOCUMENTS

| | | | |
|---|---|---|---|
| 3,988,258 | 10/1976 | Curtiss et al. | 252/628 |
| 4,173,546 | 11/1979 | Hayes | 252/628 |
| 4,505,851 | 3/1985 | Funabashi et al. | 252/628 |
| 4,518,508 | 5/1985 | Conner | 252/628 |

FOREIGN PATENT DOCUMENTS

| | | | |
|---|---|---|---|
| 0089580 | 9/1983 | European Pat. Off. | 252/628 |
| 0088587 | 9/1983 | European Pat. Off. | 252/628 |
| 0008300 | 6/1977 | Japan . | |
| 0058499 | 4/1983 | Japan . | |

*Primary Examiner*—Stephen J. Lechert, Jr.
*Assistant Examiner*—Howard J. Locker
*Attorney, Agent, or Firm*—Antonelli, Terry & Wands

[57] ABSTRACT

A process for solidifying radioactive wastes, which comprises adding, to pellet or dissolved radioactive wastes, an alkali metal silicate as a filler, silicic acid, carbonic acid or an alkaline earth metal or polyvalent metal salt thereof as a hardener, and cement as an absorbent for absorbing water to be released with the progress of the reaction and, if necessary, water and mixing and solidifying the resulting mixture to thereby prevent deterioration of water-proofness due to precipitation of readily soluble salts on the surface of a solidified substance.

15 Claims, 15 Drawing Figures

METHOD FOR SOLIDIFYING RADIOACTIVE WASTE

TECHNICAL FIELD

This invention relates to a method for solidifying radioactive waste generated, for example, in a nuclear power station and more particularly to a method for solidifying radioactive waste which is especially effective when an alkali silicate or an aqueous solution thereof is used as solidifying filler.

TECHNICAL BACKGROUND

A way of final disposal of radioactive waste is retrievable storage or ground disposal wherein the radioactive waste has to be treated to give a solidified waste constructed of a solidified body for this purpose. Cement has been used as the solidifying filler in forming the solidified radioactive waste, but lately there was developed an alkali silicate (solution), as a replacement of cement, which is most suited for the solidification and disposal of the pelletized radioactive waste with high volume, reduction (see Japanese laying-open patent publication No. 57-197,500(1982) published on Dec. 3, 1982).

It has been confirmed that when radioactive waste is treated into a solid body by using a solidifying agent prepared by mixing the alkali silicate (solution) as the solidifying filler, an inorganic phosphate compound ($P_2O_5$:$SiO_2$) as hardening agent and cement as a water absorbent, the formed solid body has favorable properties, such as high strength, high heat resistance, good durability, and the like. It was found, however, that easily soluble salts are deposited on the surface of the solidified body after hardened. In the course of the solidifying process, the solidifying agent undergoes reactions represented by the following formulae (1) and (2):

$$M_2O.nSiO_2.xH_2O + P_2O_5.SiO_2 \quad nSiO_2 + M_3PO_4 + xH_2O \tag{1}$$

$$CaO.SiO_2 + xH_2O \quad CaO.SiO_2.xH_2O \tag{2}$$

wherein M represents an alkali metal.

The above formulae (1) and (2) correspond to the hardening of the alkali silicate solution by the inorganic phosphate compound and the absorption of the generated water by cement, respectively. The salt $M_3PO_4$ (actually a mixture of $M_2HPO_4$, $MH_2PO_4$, $M_2H_2P_2O_7$, $M_3PO_4$ and their hydrates) produced in the hardening reaction (1) is an easily soluble matter, with its solubility being about 30 wt%, and is dissolved in the liberated water generated in the course of the hardening reaction (1). This dissolving reaction is competitive with the water absorbing reaction, but the former reaction advances faster than the latter since both the salt and the liberated water are formed in the same reaction. The undissolved portion of the salt remains in the hardened solidified body, but the dissolved salt migrates within the solidified body. Thus, as the phenomena observed in the hardened solidified body, there takes place the migration of the liberated water (solution) in which said salt has been dissolved and the evaporation of water from the solidified body surface. Consequently, the liberated water is shifted toward the solidified body surface due to the capillary action and is evaporated therefrom, leaving the recrystallized salt on the solid body surface. This accounts for the phenomenon of salt deposition.

The deposited salt, which is easily soluble as mentioned before, deteriorates the water resistance of the solidified radioactive waste, inviting the danger of causing leakage of radioactive nuclides into the environment. The salt deposition caused when the solidified body made by using an inorganic phosphate compound as hardening agent was left in a room and the alkali metal elution observed when the solidified body was immersed in water are shown by curves (A) of FIGS. 1 and 2, respectively. As seen from these curves (A), when an inorganic phosphate compound is used as hardening agent, approximately 1% by weight of salt is deposited when the solidified body is left in a room for 400 hours and approximately 8% by weight of alkali metal is eluted when said solidified body is immersed in water for the same period of time.

Thus, the prior art method using an inorganic phosphate compound ($P_2O_5.SiO_2$) as the hardening agent of the alkali silicate solidifying filler was attended by the problem that the salts are deposited on the surface of the produced solidified body of radioactive waste because of the formation of easily soluble salt $M_3PO_4$ in the hardening reaction, and the deposition of salts causes the deterioration of the water resistance of the solidified body which might lead to the leakage of radioactive nuclides from the solidified body.

DESCRIPTION OF THE INVENTION

An object of this invention is to provide a method for forming a solidified radioactive waste having high strength, heat resistance and durability as well as excellent water and moisture resistance by using a specific solidifying agent so that the salt formed in the hardened solidified body of the radioactive waste is made a hardly soluble matter (with a solubility of below 5% by weight) to thereby prevent the salt from being deposited on the solidified body surface.

The method of this invention is to solidify radioactive waste by using a solidifying agent prepared by mixing an alkali silicate used as solidifying filler, a hardening agent for hardening said alkali silicate, which hardening agent, used in place of the conventional inorganic phosphate compound, is reacted with the alkali silicate to form a low-solubility salt, cement used as water absorbent, and water necessary for mixing a material.

The hardening agent used in this invention is a compound containing a base which can combine with the alkali metal M in said alkali silicate to form a hardly soluble salt. The base usable in this invention includes $TaO_3^-$, $AlF_6^{3-}$, $NbO_3^-$, $SiF_6^{2-}$, $SiO_3^{2-}$, $BeF_4^{2-}$, $B_4O_7^{2-}$, $F^-$, $IO_4^-$, $CO_3^{2-}$, $ClO_4^-$, $BF_4^-$, and $ReO_4^-$. The solubility (% by weight) of the salts formed by these bases combined with the alkali metals is shown in Table 1. In the table, mark"-" means unknown.

TABLE 1

| Alkali metal / Base | $Na^+$ | $K^+$ | $Li^+$ |
|---|---|---|---|
| $TaO_3^-$ | 0.01 | 0.01 | 0.02 |
| $AlF_6^{3-}$ | 0.04 | 0.1 | — |
| $NbO_3^-$ | 0.1 | — | 0.04 |
| $SiF_6^{2-}$ | 0.67 | 1.1 | — |
| $SiO_3^{2-}$ | 0.85 | — | — |
| $BeF_4^{2-}$ | 1.7 | 1.4 | 12 |
| $B_4O_7^{2-}$ | 2.6 | — | — |
| $F^-$ | 3.9 | 48 | 0.13 |
| $IO_4^-$ | 9.3 | 0.4 | — |
| $CO_3^{2-}$ | 18 | 53 | 1.3 |

TABLE 1-continued

| Alkali metal Base | $Na^+$ | $K^+$ | $Li^+$ |
|---|---|---|---|
| $ClO_4^-$ | 66 | 1.7 | 36 |
| $BF_4^-$ | — | 0.5 | — |
| $ReO_4^-$ | — | 0.9 | — |

(unit: wt % (at 20° C.))

It was found that by using as hardening agent a compound containing a base which can meet the requirement of forming a salt with a solubility of below 5% by weight and by using an alkali silicate as a solidifying filler, it is possible to prevent the deposition of any salt and to form the desired solidified radioactive waste with high water resistance. The hardening agent, that is, the compound containing a base capable of meeting said requirement is a compound between a polyvalent metal ion selected from the group consisting of $Ca^{2+}$, $Mg^{2+}$, $Al^{3+}$ and $Fe^{3+}$ or an $H^+$ ion and an ion selected from the group consisting of $TaO_3-$, $AlF_6^{3-}$, $NbO_3-$, $SiFe^{2-}$, $SiO_3^{2-}$, $BeF_4^{2-}$, $B_4O_7^{2-}$, $F^-$, $IO_4^-$, $CO_3^{2-}$, $ClO_4^-$, $BF_4^-$ and $ReO_4^-$.

Curves (B) in FIGS. 1 and 2 show the results of actual measurement of the salt deposition rates when the solidified bodies obtained by using $CaCO_3$, $Ca(ClO_4)_2$, $CaSiF_6$ and $CaSiO_3$ as examples of said hardening agent were left in a room and the alkali metal elution rates when said solidified bodies were immersed in water. Although not shown in FIGS. 1 and 2, it was also experimentally confirmed that the substantially same result can be obtained by using other hardening agents containing the above-cited bases which can meet the above requirement.

All the bases usable in this invention are shown in Table 1, but $SiO_3^{2-}$ is the most preferred among them for the reasons following. Since $SiO_2$ occurs in nature in abundance, it is expected that the use of $SiO_3^{2-}$ base would the conducive to good compatibility of the solidified radioactive waste with nature when disposing the solidified body in nature, especially on land. Also, since $SiO_2$ is the principal component of certain rocks such as granite which occur in nature stably through the order of hundreds of years, it is considered that the use of $SiO_3^{2-}$ base would make the solidified waste more durable than when using the other bases.

As for the metal ion to be combined with the base for forming the hardener, $Ca^{2+}$ is the most preferred. This is because $Ca^{2+}$ is more easily available at lower cost than other metal ions, and also, since it occurs abundantly in nature, the solidified waste containing such ion has a good compatibility with nature in ground disposal.

As viewed above, the problems of water resistance of the solidified waste and especially the deposition of easily soluble salts on its surface can be alleviated by using as hardening agent the compounds containing the bases as shown in Table 1. Another important evaluation factor of the solidified radio-active waste is its strength. The strength is greatly influenced by the water content of the waste and the void ratio of the solidified waste. Therefore, the mixing ratios of the hardening agent, water absorbent and water, based on the ratio of the alkali silicate as the solidifying filler in the solidifying agent, will now be discussed from the standpoints of the water content and the void ratio.

FIGS. 3 and 4 illustrate the relationship between the strength of the solidified waste and the water content of the waste on one hand and the void ratio of the solidified waste on the other hand. These drawings represent the case where $CaSiO_3$ was used as hardening agent, but the similar tendency is noted when other types of hardening agent mentioned above are used. The waste originally (i.e. before solidification) contains about 3% by weight of water, and also the solidified waste invariably has at least about 10% of voids. In the graphs of FIGS. 3 and 4, the ordinate refers to the relative strength as determined by normalizing the strength under said conditions as 1.

It was found that the solidified waste becomes defective when its relative strength is below 0.5 (because of formation of cracks or other problems). Therefore, as noted from FIGS. 3 and 4, it is necessary to regulate the water content of the waste and the void ratio of the solidified waste below about 6% by weight and about 30%, respectively.

It was also disclosed that the void ratio of the solidified waste depend on the viscosity of the solidifying agent before it is hardened. That is, if the solidifying agent has a high viscosity, the air entrapped therein during stirring becomes sluggish in separating from the solidifying agent (sol) before hardening, resulting in the increased void ratio in the solidified waste. FIG. 5 shows the relationship between the void ratio of the solidified waste and the viscosity (just after the formation of sol) of the sol of the solidifying agent. For reducing the void ratio below 30%, it needs to keep the viscosity of the solidifying agent sol below 3,000 cP. Since the sol viscosity is easier to measure than the void ratio, the proper range of composition of the solidifying agent can be decided from the two factors: the water absorption of the waste and the viscosity of the solidifying agent.

FIGS. 6, 7 and 8 show the results of examination of the water content of the waste and the viscosity of the solidifying agent by keeping the mixing ratio of the alkali silicate filler constant (37.5% by weight) while changing the mixing ratios of the hardening agent, water absorbent (cement) and water. In these graphs, the amounts of the hardening agent, the cement, and the water added, respectively, are plotted as abscissa and the water content of the waste (on the left-hand vertical axis) and the viscosity of the solidifying agent (on the right-hand vertical axis) as ordinate. From these graphs and the above-mentioned allowable ranges of the water absorption of the waste (below about 6% by weight) and the viscosity of the solidifying agent just after mixing (below about 3,000 cP), it is found that the optimal ranges of the amounts of the hardening agent to be added, the cement to be added and the water to be contained are 3 to 50% by weight, 3 to 35% by weight and 15 to 40% by weight, respectively.

By using a solidifying agent having the composition as specified above, it is possible to form a solidified radioactive waste having high moisture and water resistance and substantially free of salt deposition as illustrated by curves (B) in FIGS. 1 and 2. From the experimental results shown in these figures, it is seen that in case of using the solidifying agent of this invention as represented by the curves (B) in terms of salt deposition rate, the obtained solidified waste is reduced in its salt deposition rate to more than 1/10 when it is left in a room, and when the solidified waste is immersed in water, the alkali metal elution rate is reduced to about ½, in comparison with the case of using an inorganic phosphate compound as hardening agent in which case the salt deposition rate is as depicted by the curves (A). The rather limited improvement of the alkali metal elution rate is considered attributable to the facts that the amount of alkali metal contained in the alkali silicate used as the solidifying filler in the case of curves (B) is the same as in the case of curves (A) and that the amount of water used for the immersion is far greater (about 100 times) than the volume of the solidified waste. In the case of the retrievable storage which is under the more mild conditions, the elution rate will be reduced to the level shown by the curves (B) of FIG. 1 and also the quality of the solidified waste will be greatly improved over the prior art.

BRIEF DESCRIPTION OF THE DRAWINGS

FIG. 9 shows the case where an aqueous solution of sodium silicate was used as solidifying filler and FIG. 10 shows the case where powdered sodium silicate was used as the solidifying filler.

PREFERRED EMBODIMENTS OF THE INVENTION

The embodiment illustrated in Figure pertains to a case where the radioactive waste to be treated is a concentrated liquid waste (mainly composed of $Na_2SO_4$) generated in a nuclear reactor and where the waste is dried, powdered and then pelletized, and by using a 60 wt% solution of sodium silicate ($Na_2O.nSiO_2$, $n=0.5$–$4$) as solidifying filler and calcium silicate ($CaSiO_3$) as hardening agent, the pelletized waste is solidified in a 200-l drum.

Figure 1:
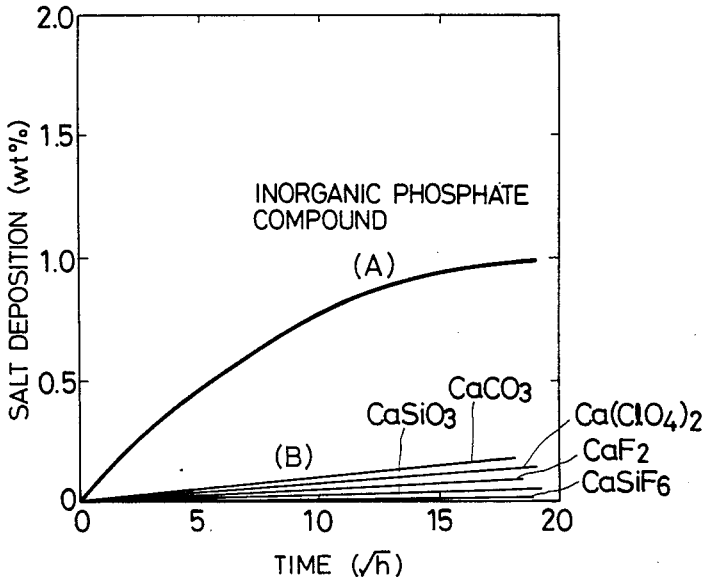
FIG. 1 is a graph showing the rate of salt deposition on the surface of the solidified waste with time when the waste was left in a room.
Figure 2:
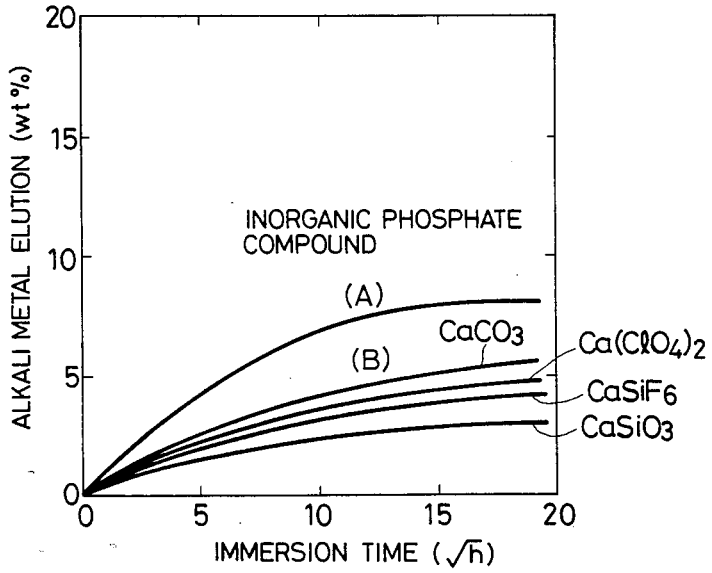
FIG. 2 is a graph showing the rate of alkali metal elution from the solidified waste with time when the waste was immersed in water. In these graphs, curves (A) represent the prior art and curves (B) represent the embodiments of this invention.
Figure 3:
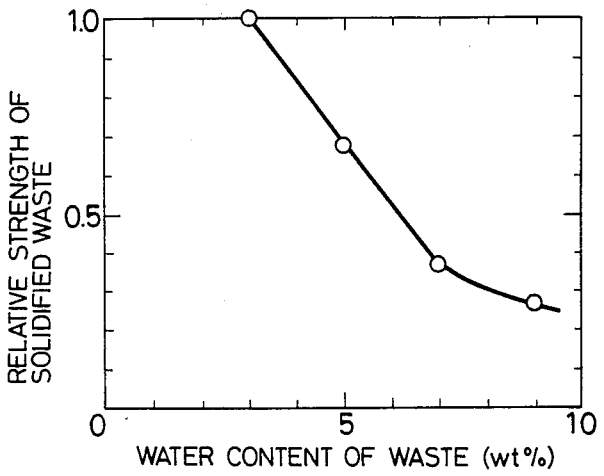
FIGS. 3 and 4 are graphs showing the influence of the water content of the waste and the void ratio in the solidified waste, respectively, on the relative strength of the waste.
Figure 4:
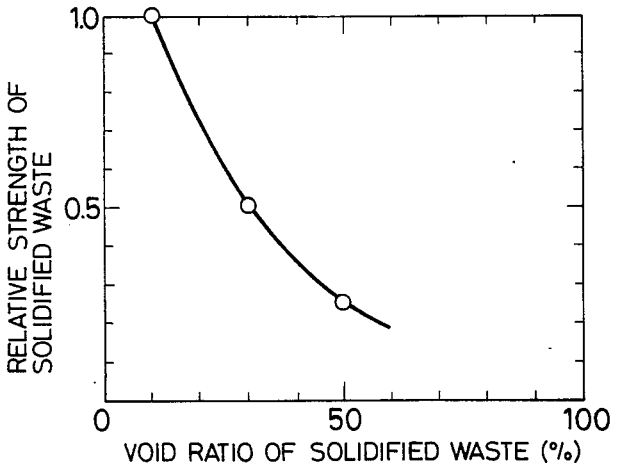
Figure 5:
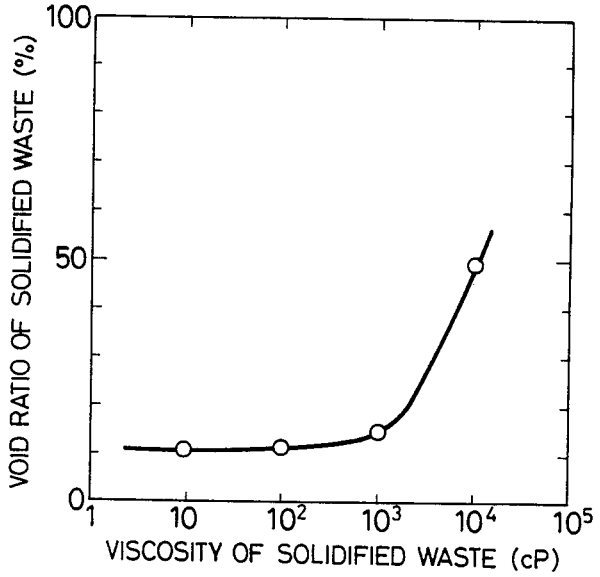
FIG. 5 is a graph showing the relation between the void ratio of the solidified waste and the viscosity of the solidifying agent.
Figure 6:
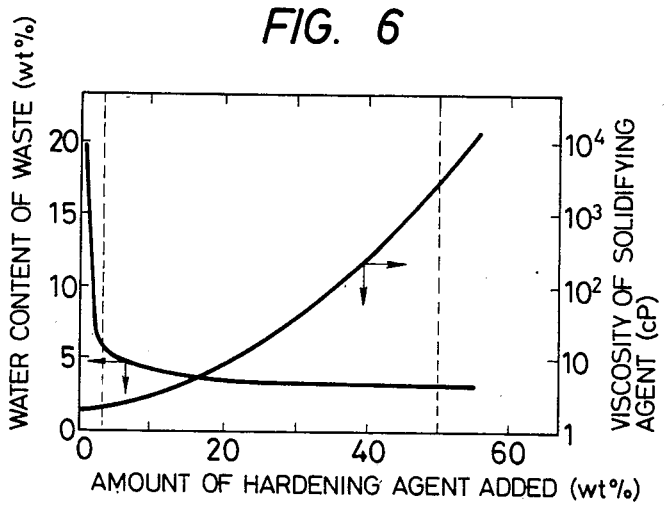
FIGS. 6, 7 and 8 are graphs showing the relationship between the amount of hardening agent, cement and water, respectively, added in the solidifying agent and water absorption of the waste and the viscosity of the solidifying agent.
Figure 7:
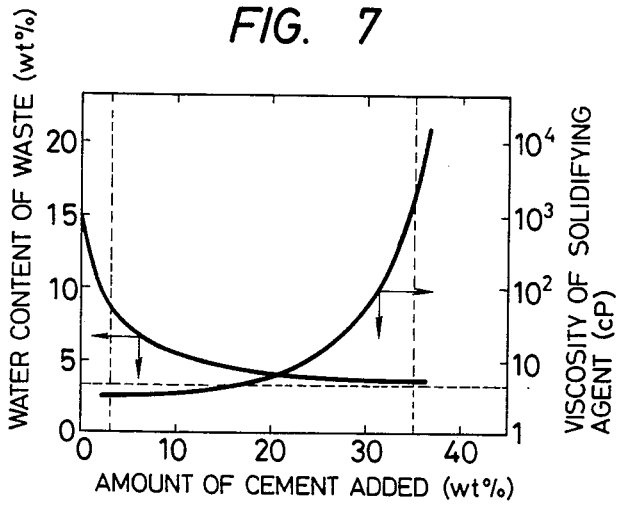
Figure 8:
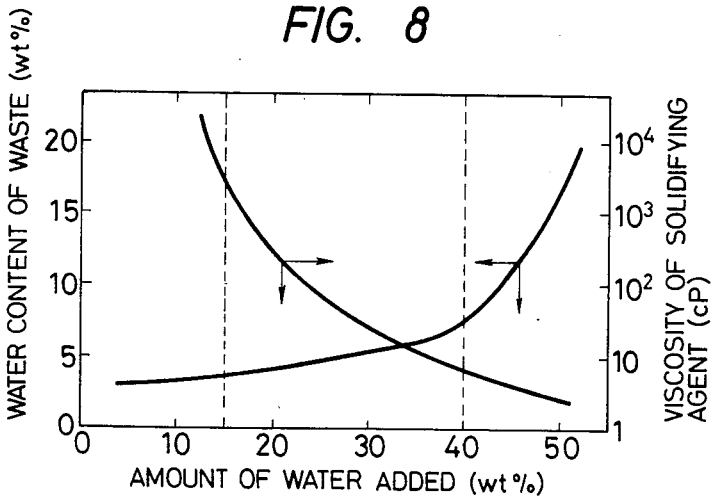
Figure 9:
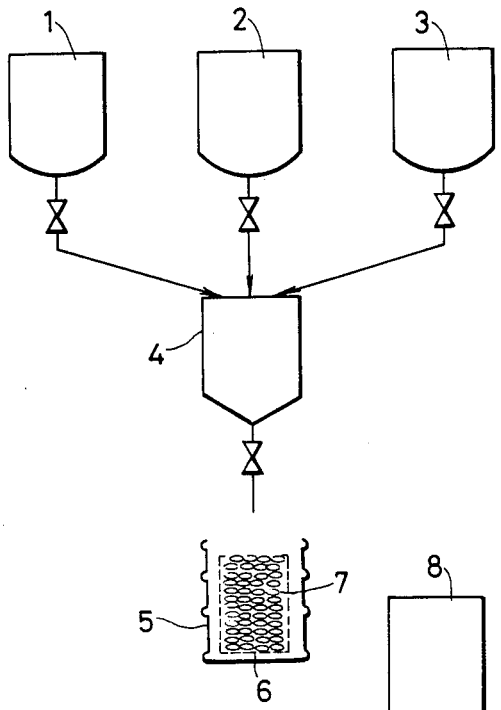
FIGS. 9 and 10 are flow sheets illustrating the embodiments of the method for solidifying radioactive waste according to this invention, where

First, as shown in FIG. 9, about 260 kg of pelletized radioactive waste 7 mainly composed of $Na_2SO_4$ is filled in a wire mesh basket 6 disposed in a 200-l drum 5. Then 150 kg of a 60 wt% solution of sodium silicate, 60 kg of calcium silicate ($CaSiO_3$) and 30 kg of cement, contained in tanks 1, 2 and 3, respectively, are supplied into a mixing stirrer 4 and homogeneously mixed therein to form a solidifying agent, which is then flown into the drum so that the solidifying agent fills the voids between the pellets themselves and between the pellets and the drum. After filling, the mixture in the drum is deaerated under a vacuum of about 50 Torr to remove air bubbles remaining in the solidifying agent and then left at room temperature to allow the solidifying agent to harden. This hardening is completed in about 2 hours.

Figure 10:
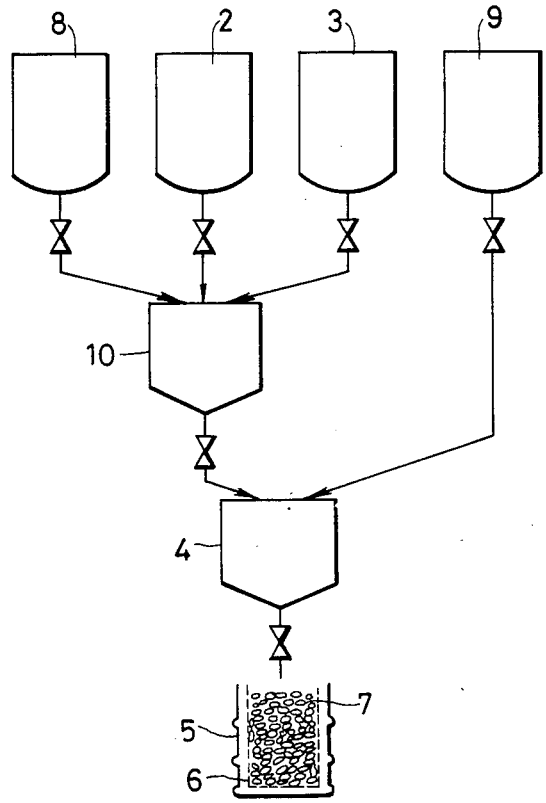

FIG. 10 depicts another embodiment of the invention where powdered sodium silicate is used in place of an aqueous solution of sodium silicate. In this case, in order to facilitate homogeneous mixing of the powder and water, the powdered sodium silicate, powdered calcium silicate, ($CaSiO_3$) and powdered cement contained in tanks 8, 2 and 3, respectively, are first supplied, in amounts of 90 kg, 60 kg and 30 kg, respectively, into a pre-mixing tank 10 and homogeneously mixed therein. This mixture is then led into a mixing tank 4 and further mixed and kneaded homogeneously with 60 kg of water supplied from a tank 9, and the formed solidifying agent is flown into a 200-l drum 5 already containing the pellets of radioactive waste 7 filled in a wire mesh basket 6. Vacuum deaeration and hardening are accomplished in the same way as in the preceding embodiment (FIG. 9).

Figure 11:
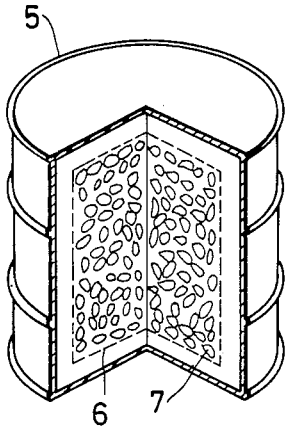
FIG. 11 is a diagrammatic drawing showing an example of the solidified waste formed according to the method of this invention.

In this way, approximately 480 kg of solidified radioactive waste as shown in FIG. 11 can be obtained. The solidified radioactive waste caused no deposition of salts on the surface nor leaching of radioactive nuclides, was free of cracks and also had a high strength.

According to these embodiments, it is possible to use either an aqueous solution or powder of sodium silicate as the solidifying filler by using calcium silicate ($CaSiO_3$) as hardening agent, and there can be obtained a pellet of solidified radioactive waste which is free of deposition of salts or leaching of radioactive nuclides and has excellent water resistance.

Figure 12:
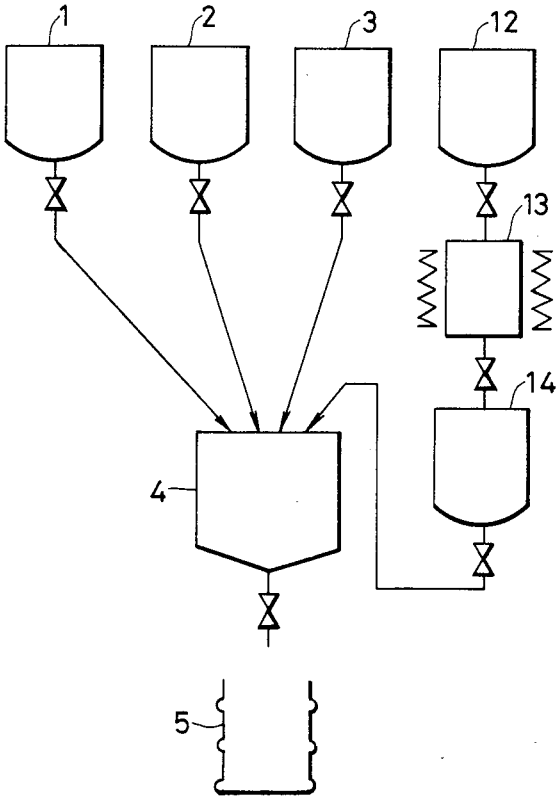
FIG. 12 is a flow sheet illustrating another embodiment of the method for solidifying radioactive waste according to this invention.

As still another embodiment of this invention, there will be described below, with reference to FIG. 12, a case where not the pelletized radioactive waste but the radioactive waste (mainly composed of $Na_2SO_4$) generated from a nuclear power station is directly treated and solidified in a 200-l drum. In this case, in order to secure the strength of the solidified waste and the proper volume reduction ratio of the waste, the radioactive liquid waste contained in a tank 12 is first dehydrated and formed into a powder in a dryer 13 and then supplied into a tank 14. Various methods are known for drying the radioactive liquid waste, such as centrifugal film drying, spray drying, fluidized bed drying, drum drying, freeze drying and crystallization, and any of these methods can be employed in this invention.

Figure 13:
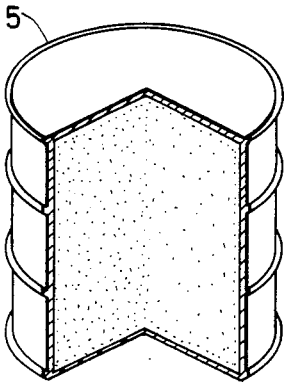
FIG. 13 is a diagrammatic drawing showing a homogeneous solidified waste formed according to the embodiment of this invention shown in FIG. 12.

After this pretreatment of the radioactive liquid waste, about 200 kg of a 60 wt% aqueous solution of sodium silicate, about 60 kg of calcium silicate ($CaSiO_3$), about 30 kg of cement and about 210 kg of powdered radioactive waste are supplied into a mixing stirrer 4 from their respective tanks 1, 2, 3 and 14 and homogeneously stirred and mixed. This mixture is then flown into and filled in a 200-l drum 5. Vacuum dearation is also conducted to eliminate the air bubbles remaining in the solidifying agent. Thus, by using sodium silicate as filler and calcium silicate ($CaSiO_3$) as hardening agent thereof, it is possible to make a homogeneous, water-resistant solidified radioactive waste as shown in FIG. 13.

Figure 14:
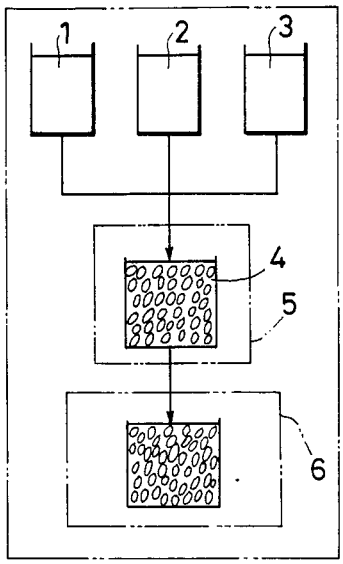
FIG. 14 is a flow sheet illustrating the method of forming a solidified radioactive waste according to the other embodiment.
Figure 15:
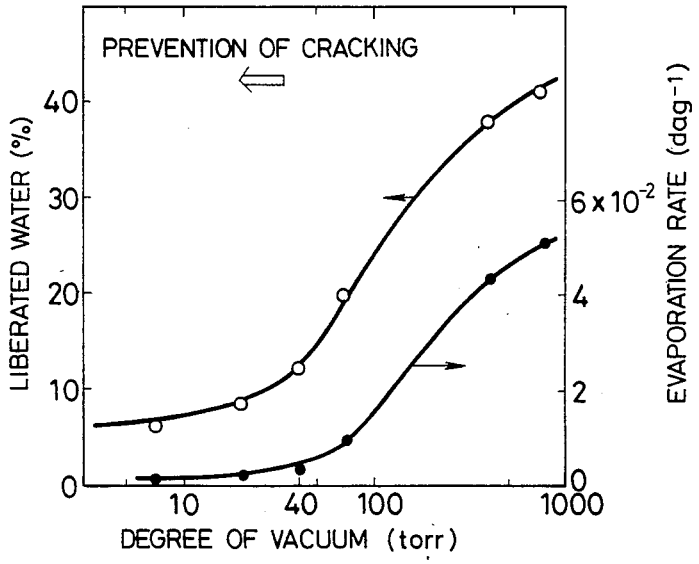
FIG. 15 is a graph showing the amount of liberated water contained in the solidified body and the evaporation rate of the liberated water as a function of the degree of vacuum at the time of hardening.

An embodiment of this invention will now be described with reference to FIG. 14.

An alkali silicate solution used as the solidifying filler, Portland cement used as the water absorbent and calcium silicate ($CaSiO_3$) used as the hardening agent or durability improver are mixed and this mixture is filled in the pelletized radioactive waste. The pellet is deaerated under a vacuum of below 100 Torr for effecting homogeneous and dense filling. After deaeration, the whole mass is kept under a vacuum of below 40 Torr at 20° C. until the hardening is completed.

According to this embodiment of the invention, the liberated water is urged to evaporate from the alkali silicate solution while the mixed mass is kept under a vacuum of below 40 Torr, and by the time the hardening is completed, the water content is reduced to around 11% to reach an equilibrium with the humidity of the ambient air. Accordingly, the evaporation rate of the liberated water becomes less than $1\%/deg^{-1}$. It is thus possible to form a sound solidified radioactive waste which is free of cracks that are injurious to the strength and water resistance of the solidified body.

The invention has been described regarding some embodiments thereof where the radioactive waste (in the form of pellets or liquid) mainly composed of sodium sulfate, such waste being generated in boiling water reactors, is solidified, but the method of this invention can be equally and as effectively applied to the treatment of radioactive waste mainly composed of boron such as one generated in pressurized water reactors and waste ion exchange resins.

In case of treating the pelletized radioactive waste, the same effect can be obtained by mixing the pelletized waste with a sodium silicate solution (or powder of sodium silicate and water), calcium silicate ($CaSiO_3$) and cement and filling this mixture in a drum, instead of having the drum previously filled with the pelletized radioactive waste.

Also, in the above-described embodiments, the radioactive waste mixture is filled in a basket 6 placed in the drum 5 so that the pellets of radioactive waste will not touch the inner wall of the drum, but it is also possible to attain secure solidification and fixing of the pelletized waste inside the drum by lining the drum with a fibrous material such as glass fiber, asbestos, carbon fiber, or metal fiber.

Further, in the embodiments described above, the air bubbles in the filled solidifying agent are removed by means of vacuum deaeration, but the similar effect can be provided by giving vibrations to or heating the drum after filled with the solidifying agent.

According to the present invention, it is possible to make a solidified radioactive waste which is free of deposition of easily soluble salts on its surface, very scanty in leaching of radioactive nuclides and excellent in moisture and water resistance, by using a solidifying agent containing an alkali silicate or an aqueous solution thereof as solidifying filler.

We claim:

1. A method for solidifying radioactive waste which comprises mixing the radioactive waste with a solidifying agent prepared by mixing an alkali metal silicate as a solidifying filler; an inorganic compound as a hardening agent for reacting with said alkali metal silicate; cement as a water absorbent for absorbing liberated water generated in the course of the hardening reaction between said alkali metal silicate and said inorganic compound; and water; wherein said inorganic compound contains an ion able to bind with an alkali metal in said alkali metal silicate to form a low-solubility salt, said inorganic compound being a compound of a polyvalent metal ion selected from the group consisting of $Ca^{2+}$, $Mg^{2+}$, $Al^{3+}$, and $Fe^{3+}$ or an $H^+$ ion and an ion selected from the group consisting of $TaO_3^-$, $AlF_6^{3-}$, $NbO_3^-$, $SiF_6^{2-}$, $SiO_3^{2-}$, $BeF_4^{2-}$, $B_4O_7^{2-}$, $F^-$, $IO_4^-$, $ClO_4^-$, $BF_4^-$ and $ReO_4^-$.

2. A method for solidifying radioactive waste according to claim 1, wherein the content of said inorganic compound in the solidifying agent is not less than 3% by weight but not greater than 50% by weight.

3. A method for solidifying radioactive waste according to claim 1, wherein the content of said cement in the solidifying agent is not less than 3% by weight but not greater than 35% by weight.

4. A method for solidifying radioactive waste according to claim 1, wherein the content of said water in the solidifying agent is not less than 15% by weight but not greater than 40% by weight.

5. A method for solidifying radioactive waste according to claim 1, wherein said alkali metal silicate is selected from the group consisting of sodium silicate, potassium silicate and lithium silicate.

6. A method for solidifying radioactive waste according to claim 1, wherein said inorganic compound is $CaSiO_3$.

7. A method for solidifying radioactive waste according to claim 1, wherein said alkali metal silicate is sodium silicate.

8. A method for solidifying radioactive waste according to claim 7, wherein said inorganic compound is $CaSiO_3$.

9. A method for solidifying radioactive waste according to claim 2, wherein the content of said alkali metal silicate as a solidifying filler in the solidifying agent is about 37.5% by weight.

10. A method for solidifying radioactive waste according to claim 3, wherein the content of said alkali metal silicate as a solidifying filler in the solidifying agent is about 37.5% by weight.

11. A method for solidifying radioactive waste according to claim 4, wherein the content of said alkali metal silicate as a solidifying filler in the solidifying agent is about 37.5% by weight.

12. A method for solidifying radioactive waste according to claim 1, wherein the viscosity of the solidifying agent before it is hardened is less than about 3,000 cP.

13. A method for solidifying radioactive waste according to claim 1, wherein the radioactive waste and the solidifying agent are mixed in approximately equal amounts by weight.

14. A method for solidifying radioactive waste according to claim 1, wherein the content of said inorganic compound in the solidifying agent is not less than 3% by weight but not greater than 50% by weight; the content of said cement in the solidifying agent is not less than 3% by weight but not greater than 35% by weight; the content of said water in the solidifying agent is not less than 15% by weight but no greater than 40% by weight; and the content of said alkali metal silicate in the solidifying agent is about 37.5% by weight.

15. A method for solidifying radioactive waste according to claim 8, wherein the content of said inorganic compound in the solidifying agent is not less than 3% by weight but not greater than 50% by weight; the content of said cement in the solidifying agent is not less than 3% by weight but not greater than 35% by weight; the content of said water in the solidifying agent is not less than 15% by weight but not greater than 40% by weight; and the content of said alkali metal silicate in the solidifying agent is about 37.5% by weight.

* * * * *